US007337632B2

(12) United States Patent
Bruno et al.

(10) Patent No.: US 7,337,632 B2
(45) Date of Patent: Mar. 4, 2008

(54) EARRING WITH FLOATING DECORATIVE ELEMENT

(75) Inventors: Lisa Bruno, New York, NY (US); Dana Castle, Keene, NH (US)

(73) Assignee: Findings Incorporated, Keene, NH (US)

( * ) Notice: Subject to any disclaimer, the term of this patent is extended or adjusted under 35 U.S.C. 154(b) by 26 days.

(21) Appl. No.: 11/253,898

(22) Filed: Oct. 19, 2005

(65) Prior Publication Data

US 2007/0084240 A1 Apr. 19, 2007

(51) Int. Cl.
*A44C 7/00* (2006.01)

(52) U.S. Cl. ..... 63/13

(58) Field of Classification Search ..... None
See application file for complete search history.

(56) References Cited

U.S. PATENT DOCUMENTS

| | | | | |
|---|---|---|---|---|
| 263,755 | A * | 9/1882 | Braverman | 63/12 |
| 4,218,894 | A | 8/1980 | Tropea | |
| 4,259,850 | A | 4/1981 | Lalieu | |
| D264,060 | S | 4/1982 | Epstein | |
| D265,894 | S | 8/1982 | Barr | |
| D271,952 | S | 12/1983 | Altman | |
| D303,640 | S | 9/1989 | Pizarro | |
| 5,074,128 | A | 12/1991 | Kowalski | |
| D374,637 | S | 10/1996 | Esser | |
| 5,577,396 | A | 11/1996 | Cannon | |
| D418,079 | S | 12/1999 | Porcell | |
| D420,304 | S | 2/2000 | Porcell | |
| 6,508,081 | B1 | 1/2003 | Simpson | |
| 2005/0092020 | A1 | 5/2005 | David | |

OTHER PUBLICATIONS

The BME Encyclopedia's Barbell. (N.D.). Retrieved Oct. 10, 2005, from http://encyc.bmezine.com/?barbell.

The BME Encyclopedia's Curved Barbell. (N.D.). Retrieved Oct. 10, 2005, from http://encyc.bmezine.com/?curved_barbell.

The BME Encyclopedia's J-Bar. (N.D.). Retrieved Oct. 10, 2005, from http://encyc.bmezine.com/?j-bar.

Body Jewellery Shop's Bananabells. (N.D.). Retrieved Oct. 10, 2005, from http://www.bodyjewelleryshop.co.uk/body_jewellery_shop/productcategory.cfm?sc=bananabells_1mm_3201222.cfm.

Body Jewellery Shop's Flower Droppers. (N.D.). Retrieved Oct. 10, 2005, from http://www.bodyjewelleryshop.co.uk/body_jewellery_shop/productcategory.cfm?sc=flower_dropper_bananabells_242.cfm.

Earrings by Orogem. (N.D.). Retrieved Oct. 13, 2005, from http://www.orogem.com/fine_jewelry.asp?compview=all&collectionid=5&stonetypei.

(Continued)

*Primary Examiner*—Jack W. Lavinder
(74) *Attorney, Agent, or Firm*—Wilmer Cutler Pickering Hale and Dorr LLP

(57) ABSTRACT

In accordance with one or more embodiments of the invention, an earring has a decorative element that is held below the bottom of the ear by a continuously curved wire member. The end of the curved wire member opposite the decorative element is secured to the ear by a releasable securing element, which may also be ornamental. The overall design of the earring maintains the decorative element and the securing element in the same plane and in substantial vertical relation. In accordance with another embodiment of the invention, an earring enhancement has a decorative element that is held below the bottom of the ear. A curved wire member having a substantially straight portion maintains the position of the decorative element. One end of the curved wire member is configured to slide onto the post of a traditional earring.

10 Claims, 4 Drawing Sheets

OTHER PUBLICATIONS

Earrings by Orogem. (N.D.). Retrieved Jan. 13, 2006, from http://orogem.com/fine_jewelry.asp?compview=all&collectionid=5&stonetypei.

Painful Pleasures Body Jewelry's Bent Barbell. (N.D.) Retrieved Oct. 10, 2005, from http://www.painfulpleasures.com/xcart/customer/home.php?cat=2&page=1.

* cited by examiner

EARRING WITH FLOATING DECORATIVE ELEMENT

BACKGROUND OF THE INVENTION

1. Field of Invention

The present invention generally relates to the field of jewelry and specifically to earrings. More specifically, the present invention relates to earrings having a decorative element held below the ear, wherein an empty space is maintained between the ear and the decorative element. In one embodiment, the present invention relates to an earring enhancement.

2. Description of Related Art

The use of earrings to adorn the body has long been known. Numerous styles of earrings exist to suit one's taste, budget, and sense of fashion. Earrings vary in the way they attach to the body. Earrings may be clamped to the ear; they may pass through a piercing of an earlobe; or they may be held on the body through the use of magnets. Earrings also vary greatly in their individual appearance and range from a simple single stud design to elaborate designs.

Among the variety of earring designs is one that holds a decorative element below the ear, so as to maintain an empty space between the bottom of the ear and the decorative element. However, the current designs suffer from drawbacks, which make the designs undesirable.

BRIEF SUMMARY OF EMBODIMENTS OF THE INVENTION

In accordance with one or more embodiments of the invention, an earring has a decorative element that is held below the bottom of the ear by a continuously curved wire member. The end of the curved wire member opposite the decorative element passes from rear to front through a pierced channel of an earlobe. This end is secured to the ear by a releasable securing element, which may also be ornamental. At least one embodiment of the invention also provides an optional backstop disposed on the curved member. This backstop provides support, prevents the earring from tipping forward, and improves the wearability of the earring by evenly distributing pressure across the backstop. The overall design of the earring maintains the decorative element and the securing element in the same plane and in substantial vertical relation.

In accordance with another embodiment of the invention, an earring enhancement has a decorative element that is held below the bottom of the ear. A curved wire member having a substantially straight portion maintains the position of the decorative element. One end of the curved wire member is configured to slide onto the post of a traditional earring. Thus, a traditional earring, worn in the conventional manner, supports the curved wire member.

These and other features will become readily apparent from the following detailed description wherein embodiments of the invention are shown and described by way of illustration.

BRIEF DESCRIPTION OF THE DRAWINGS

For a more complete understanding of various embodiments of the present invention, reference is now made to the following descriptions taken in connection with the accompanying drawings in which.

Like reference numerals refer to like elements in the drawings.

DETAILED DESCRIPTION OF THE PREFERRED EMBODIMENTS

Figure 1:
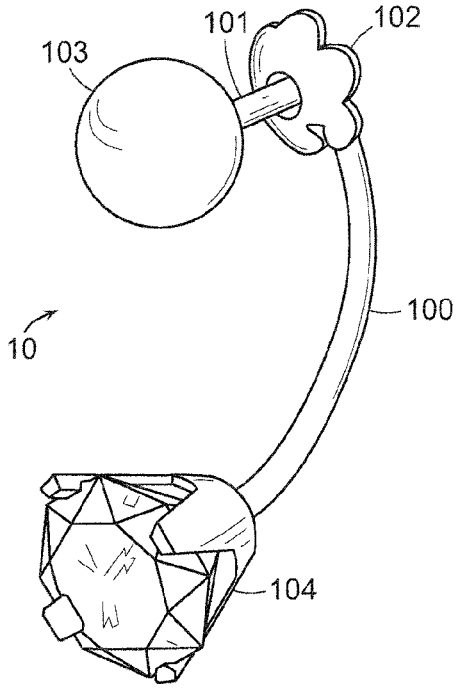
FIG. 1 illustrates an earring in accordance with one or more embodiments of the invention.

FIG. 1 illustrates one embodiment of an earring according to the invention. Referring to FIG. 1, an earring 10 includes a curved wire member 100, having a substantially straight end section 101. Straight end section 101 passes from rear to front through a pierced channel of an ear (not shown), leaving a portion of straight end section 101 protruding from the front of the ear, and bringing an optional backstop 102 in contact with the rear of the ear. Straight end section 101 is secured to the ear by a releasable securing element 103. Mechanisms to releasably connect straight end section 101 and securing element 103 may include, but are not limited to, complementary threading. Securing element 103 may also serve an ornamental function.

As a result, a decorative element 104 is held suspended below the bottom of the ear, in substantial vertical alignment with and in substantial coplanar relationship to securing element 103 and in substantial fixed relation to the ear. Thus, decorative element 104 appears to float below the bottom of the ear. Decorative element 104 may be any of a number of decorations well known in the art. By way of example and not by way of limitation, decorative element 104 may be one or a combination of the following materials: a stone, a pearl, a stone in a gem mount, a crystal, a figurine, a sphere of metal, or a three-dimensional shape of metal. Securing element 103 may also be constructed of the same variety of materials.

Figure 2:
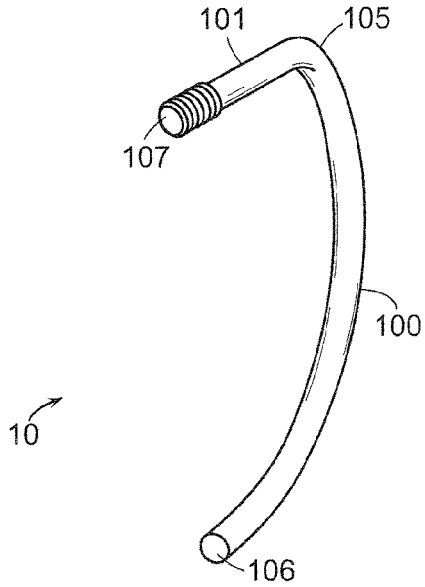
FIG. 2 illustrates the earring of FIG. 1 with the decorative element, securing element, and backstop removed for illustration purposes.

FIG. 2 illustrates earring 10 with the decorative element, securing element, and optional backstop removed for illustration purposes. The earring includes a transition point 105 where curved wire member 100 transitions into substantially straight end section 101. As stated above, straight end section 101 may have a threaded end section 107 for attachment to removed securing element 103 of FIG. 1. An end section 106 of curved wire member 100 serves as the mounting point for removed decorative element 104 of FIG. 1. Decorative element 104 may be permanently attached to end section 106 by means of soldering, welding, gluing or other permanent means. Alternatively, decorative element 104 may be removably attached by threading or another removable connection mechanism.

Figure 3:
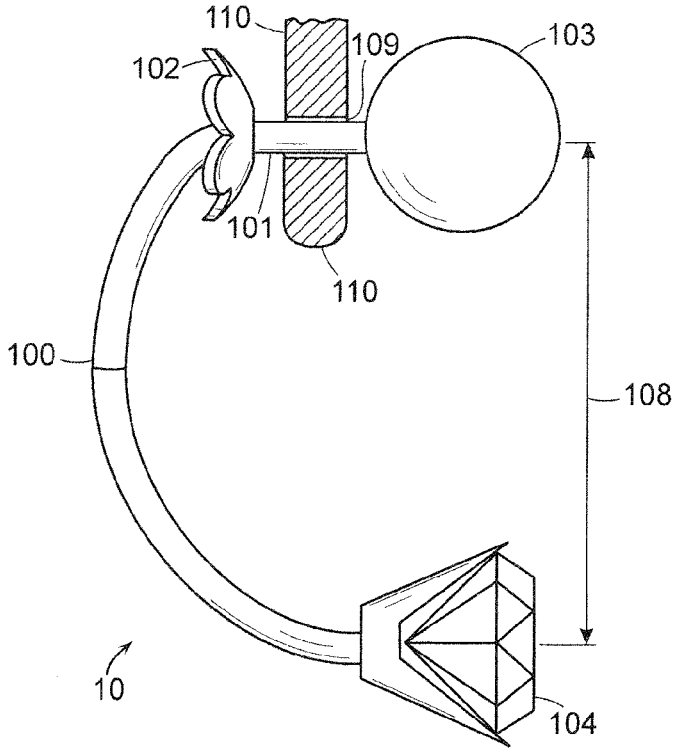
FIG. 3 illustrates a right side view of the earring of FIG. 1, showing the chord length of the curved member.

FIG. 3 illustrates a right side view of earring 10. A chord length 108 is the straight-line distance between the centerline of securing element 103 and the centerline of decorative element 104. The chord length 108 is determined by the length and curve of curved wire member 100. In at least one embodiment, chord length 108 is such that the distance between decorative element 104 and the bottom of an ear lobe 110 is between about 0 inches and 1 inch, but could be more if desired. Curved wire member 100 may be of varying lengths and varying curvatures depending on the type and style of decorative element 104 and the aesthetic effect desired. Curved wire member 100 may be constructed of various materials; the materials may include, but are not limited to, metal or polymer.

Straight end section 101 of curved wire member 100 passes through a pierced channel 109 of earlobe 110. In embodiments having optional backstop 102, the earring is thus held in fixed relation to earlobe 110 by backstop 102 and securing element 103. Backstop 102 provides a bracing and support function for earring 10, which prevents forward movement of straight end section 101 in pierced channel 109. This helps to ensure curved wire member 100 does not tip forward in pierced channel 109. Backstop 102 also improves the wearability of earring 10 by evenly distributing any pressure on earlobe 110 across backstop 102. Backstop 102 may take the form of a small, flat, and circular piece of material. In at least one embodiment, backstop 102 is a circular meniscus lens shaped piece of material with scalloped edges. Backstop 102 is not limited to these forms and may take the form of any shape effective at providing the bracing and support function described above. Backstop 102 may be constructed of a variety of materials similar to those of curved wire member 100, and may be permanently attached to curved wire member 100 by means of soldering, welding, gluing or other permanent means.

Figure 4:
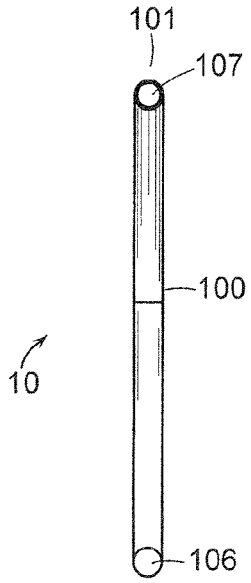
FIG. 4 illustrates the front plan view of the earring of FIG. 1 with the decorative element, securing element, and backstop removed for illustration purposes.

FIG. 4 illustrates the front plan view of earring 10 with the decorative element, securing element, and optional backstop removed for illustration purposes. Curved wire member 100 transitions into substantially straight end section 101, having threaded end section 107. On the opposing end of curved wire member 100 is end section 106, which serves as the mounting point for removed decorative member 104 of FIG. 3.

Figure 5:
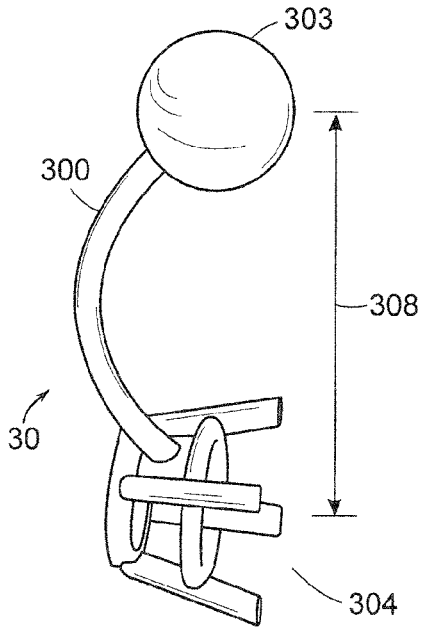
FIG. 5 illustrates an earring in accordance with a further embodiment of the invention, showing the chord length of the curved member.

FIG. 5 illustrates a right side view with slight perspective of an earring 30. A chord length 308 is the straight-line distance between the centerline of a securing element 303 and the centerline of a decorative element 304. The chord length 308 is determined by the length and curve of curved a wire member 300. In at least one embodiment, chord length 308 is such that the distance between decorative element 304 and the bottom of an ear lobe (not shown) is between about 0 inches and 1 inch, but could be more if desired. Curved wire member 300 may be of varying lengths and varying curvatures depending on the type and style of decorative element 304 and the aesthetic effect desired. Curved wire member 300 may be constructed of various materials; the materials may include, but are not limited to, metal or polymer.

One portion of curved wire member 300 passes from rear to front through a pierced channel of an ear (not shown), leaving an end portion of curved wire member 300 protruding from the front of the ear. Curved wire member 300 is secured to the ear by a releasable securing element 303. Mechanisms to releasably connect curved wire member 300 and securing element 303 may include, but are not limited to, complementary threading. Securing element 303 may also serve an ornamental function. Securing element 303 may be constructed of the same variety of materials as decorative element 304.

As a result of the overall design, decorative element 304 is held suspended below the bottom of the ear, in substantial vertical alignment with and in substantial coplanar relationship to securing element 303 and in substantial fixed relation to the ear. Thus, decorative element 304 appears to float below the bottom of the ear. Decorative element 304 may be any of a number of decorations well known in the art. By way of example and not by way of limitation, decorative element 304 may be one or a combination of the following materials: a stone, a pearl, a stone in a gem mount, a crystal, a figurine, a sphere of metal, or a three-dimensional shape of metal. Decorative element 304 may be permanently attached to an end portion of curved wire member 300 by means of soldering, welding, gluing or other permanent means. Alternatively, decorative element 304 may be removably attached by threading or another removable connection mechanism.

Figure 6:
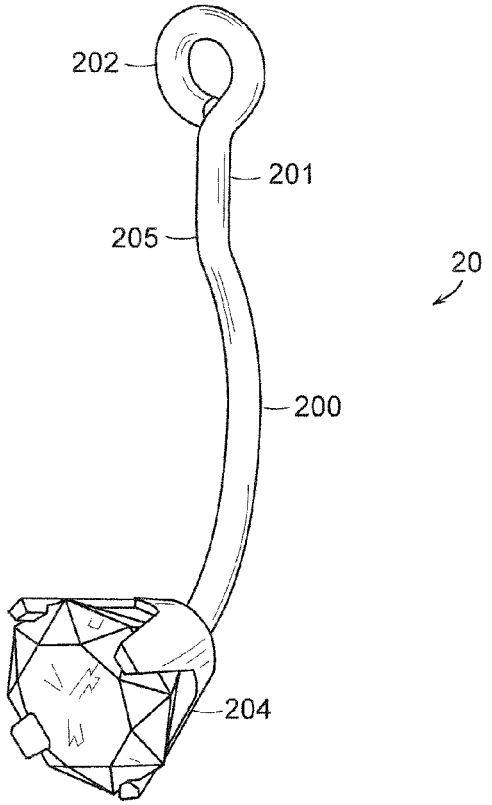
FIG. 6 illustrates an earring enhancement in accordance with one or more embodiments of the invention.

FIG. 6 illustrates one embodiment of an earring enhancement according to the invention. Referring to FIG. 6, an earring enhancement 20 includes a curved wire member 200, transitioning at a transition point 205 to a substantially straight end section 201. Straight end section 201 is connected to an attachment member 202. Attachment member 202 releasably attaches to the post of a traditional earring (not shown); this may be accomplished by sliding attachment member 202 over the post of the traditional earring.

As a result, a decorative element 204 is held suspended below the bottom of the ear, in substantial vertical alignment with and in substantial coplanar relationship to the ornament of the traditional earring and in substantial fixed relation to the ear. Thus, decorative element 204 appears to float below the bottom of the ear. Decorative element 204 may be any of a number of decorations well known in the art. By way of example and not by way of limitation, decorative element 204 may be one or a combination of the following materials: a stone, a pearl, a stone in a gem mount, a crystal, a figurine, a sphere of metal, or a three-dimensional shape of metal.

Figure 7:
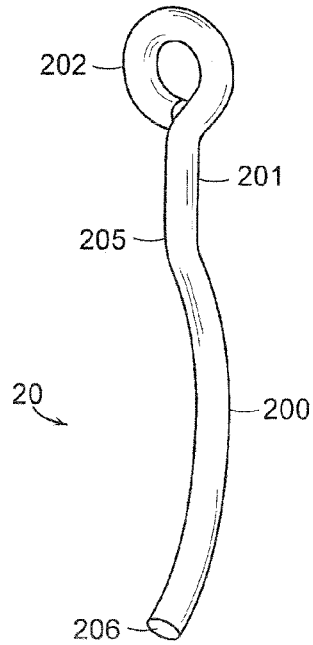
FIG. 7 illustrates the earring enhancement of FIG. 6 with the decorative element removed for illustration purposes.

FIG. 7 illustrates earring enhancement 20 with the decorative element removed for illustration purposes. The earring includes transition point 205 where curved wire member 200 transitions into substantially straight end section 201. An end section 206 of curved wire member 200 serves as the mounting point for removed decorative element 204 of FIG. 6. Decorative element 204 may be permanently attached to end section 206 by means of soldering, welding, gluing or other permanent means. Alternatively, decorative element 204 may be removably attached by threading or another removable connection mechanism.

Figure 8:
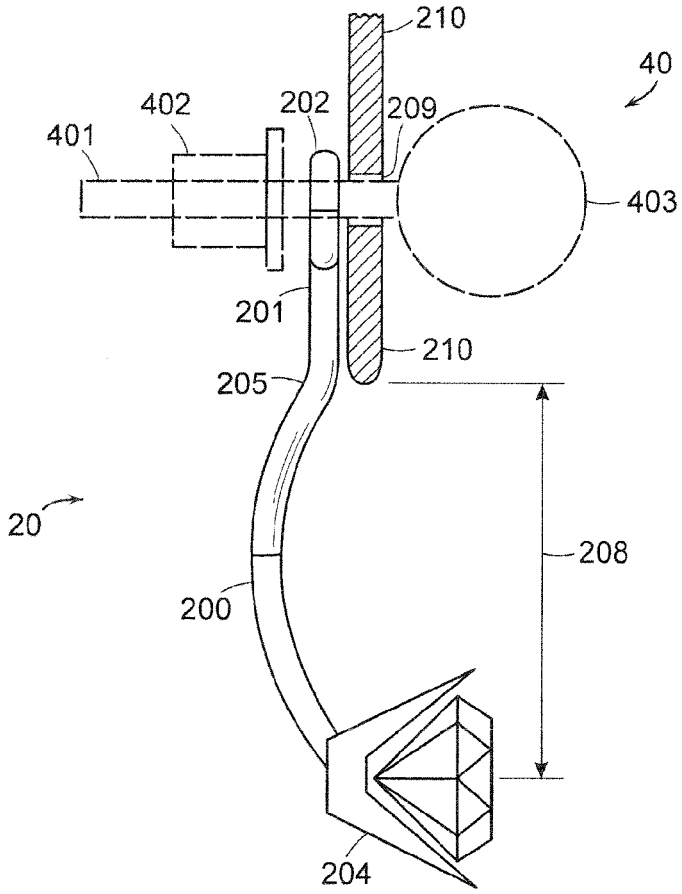
FIG. 8 illustrates a right side view of the earring enhancement of FIG. 6, showing the chord length of the curved section.

FIG. 8 illustrates a right side view of earring enhancement 20. A chord length 208 is the straight-line distance between transition point 205 and the centerline of decorative element 204. The chord length 208 is determined by the length and curve of curved wire member 200. The chord length 208 is such that the distance between decorative element 204 and the bottom of an ear lobe 210 is typically between about 0 inches and 1 inch, but could be more if desired. Curved wire member 200 may be of varying lengths and varying curvatures depending on the type and style of decorative element 204 and the aesthetic effect desired. Curved wire member 200 may be constructed of various materials; the materials may include, but are not limited to, metal or polymer.

Attachment member 202 releasably attaches to a post 401 of a traditional earring 40. When the traditional earring 40 is worn in the conventional manner, post 401 passes through a pierced channel 209 of earlobe 210. In at least one embodiment, attachment member 202 slides onto post 401. Attachment member 202 thus supports earring enhancement 20. Attachment member 202 may be in front of or behind earlobe 210. In at least one embodiment, attachment member 202 is behind earlobe 210. In this embodiment, earring enhancement 20 is held in fixed relation to earlobe 210 by the rear surface of earlobe 210 and a traditional earring nut 402. In an alternate embodiment (not shown), attachment member 202 is in front of earlobe 210. In such case, earring enhancement 20 is held in fixed relation to earlobe 210 by the front surface of earlobe 210 and a traditional earring ornament 403. In both alternate embodiments, straight end section 201 of curved wire member 200 passes along the surface of earlobe 210. Straight end section 201 provides a bracing and support function for earring enhancement 20, which helps ensure curved wire member 200 does not tip forward or backward in relation to earlobe 210.

Figure 9:
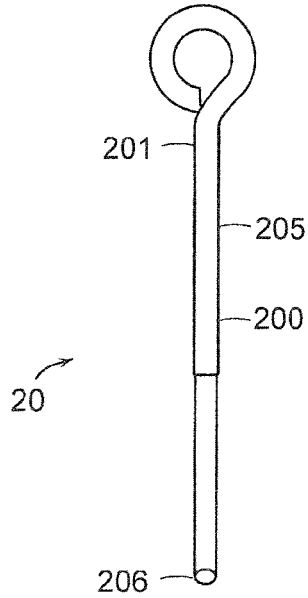
FIG. 9 illustrates the front plan view of the earring enhancement of FIG. 6 with the decorative element removed for illustration purposes.

FIG. 9 illustrates the front plan view of earring enhancement 20 with the decorative element removed for illustration purposes. Curved wire member 200 transitions into substantially straight end section 201 at transition point 205. On the opposing end of curved wire member 200 is end section 206, which serves as the mounting point for removed decorative member 204 of FIG. 8.

As will be realized, the invention is capable of other and different embodiments and its several details may be capable of modifications in various respects, all without departing from the invention. Accordingly, the drawings and description are to be regarded as illustrative in nature and not in a restrictive or limiting sense with the scope of the application being indicated in the claims.

What is claimed is:

1. An earring comprising:

a decorative element;

a securing element, for releasably securing the earring to a human ear; and a curved wire member having a continuous curve, having a first end and a second end, wherein the first end is attached to the decorative element and the second end releasably attaches to the securing element, such that when the earring is worn, the decorative element is held apart from the securing element at a distance substantially equal to the chord length of the member, and in substantial vertical alignment with the securing element.

2. The earring of claim 1 wherein the curve is substantially constant along its entire length.

3. An earring comprising:

a decorative element;

a securing element, for releasably securing the earring to a human ear;

a curved wire member, having a first end and a second end, wherein the first end is attached to the decorative element and the second end has a substantially straight end section and further wherein a curved portion of the curved wire member intersects a plane perpendicular to the substantially straight end section at two points along the curved portion of the curved wire member; and the substantially straight end section, having a first straight end and a second straight end, wherein said first straight end transitions into a curved section of the curved wire member and said second end releasably attaches to the securing element such that when the earring is worn, the decorative element is held apart from the securing element at a distance substantially equal to the chord length of the curved section of the curved wire member, and in substantial vertical alignment with the securing element.

4. The earring of claim 3, further comprising a backstop disposed on the substantially straight end section between a first end and second end of the straight section; said backstop preventing backward movement of the ear, relative to a substantially straight member portion, past said backstop and toward the curved section.

5. An earring enhancement comprising:

a decorative element;

an attachment member, configured to slidably attach to a post of a pierced earring;

a curved wire member, having a first end and a second end, wherein the first end is attached to the decorative element and the second end is integral to a first straight end of a substantially straight end section of the curved wire member, wherein a curved portion of the curved wire member intersects a plane parallel to the substantially straight end section at two points along the curved portion of the curved wire member; and the substantially straight end section, having a second straight end, wherein said first straight end transitions into a curved section of the curved wire member and said second straight end is united with the attachment member, such that when the earring is worn, the decorative element is held apart from the point at which said first straight end transitions into said curved section of the curved wire member at a distance substantially equal to the chord length of the curved section, and in substantial vertical alignment with the attachment member.

6. The earring of claim 1 or 3, or the earring enhancement of claim 5, wherein the distance from the decorative element and effective bottom of the ear falls within the range of about 0 inches to about 1 inch.

7. The earring of claim 1 or 3, wherein the decorative element and the securing element are substantially coplanar.

8. The earring enhancement of claim 5, wherein the decorative element and an ornament of the earring are substantially coplanar.

9. The earring enhancement of claim 5, wherein the distance from the decorative element and effective bottom of the ear falls within the range of about 0.5 inches to about 1 inch.

10. The earring enhancement of claim 5, wherein the plane includes the substantially straight section and further wherein the curved portion of the curved wire member is substantially on a first side of the plane and the decorative element is substantially on a second side of the plane opposite the first side.

* * * * *